US006478842B1

(12) United States Patent
Gressel et al.

(10) Patent No.: US 6,478,842 B1
(45) Date of Patent: Nov. 12, 2002

(54) PREPARATION OF ARTICLES USING METAL INJECTION MOLDING

(75) Inventors: Stephen H Gressel, Rome; Matthew M Marley, Ilion; Maryann Wright, Utica, all of NY (US)

(73) Assignee: R. A. Brands, LLC, Madison, NC (US)

( * ) Notice: Subject to any disclaimer, the term of this patent is extended or adjusted under 35 U.S.C. 154(b) by 1 day.

(21) Appl. No.: 09/619,508

(22) Filed: Jul. 19, 2000

(51) Int. Cl.[7] ..... B22F 3/12
(52) U.S. Cl. ..... 75/246; 75/248
(58) Field of Search ..... 75/246, 248

(56) References Cited

U.S. PATENT DOCUMENTS 4,734,237 A 3/1988 Faneli et al.
4,992,236 A * 2/1991 Shira ..... 419/28
5,062,638 A 11/1991 Shira
5,217,227 A 6/1993 Shira
5,228,694 A * 7/1993 Okumoto et al. ..... 273/169
5,397,531 A * 3/1995 Peiris et al. ..... 419/36
5,665,014 A 9/1997 Sanford et al.
5,669,825 A 9/1997 Shira
5,985,208 A 11/1999 Zedalis et al.
5,993,507 A 11/1999 Baum et al.
6,045,601 A * 4/2000 Tan ..... 75/248
6,048,379 A * 4/2000 Bray et al. ..... 75/229

* cited by examiner

*Primary Examiner*—Ngoclan Mai
(74) *Attorney, Agent, or Firm*—Womble Carlyle Sandridge & Rice, PLLC

(57) ABSTRACT

A process for preparation of molded articles, such as golf club heads, by metal injection molding and the resulting product.

6 Claims, No Drawings

PREPARATION OF ARTICLES USING METAL INJECTION MOLDING

BACKGROUND OF THE INVENTION

A wide variety of production techniques have previously been used in the preparation of golf club heads. Among these are traditional forging, investment casting and powder metallurgical processes. However, prior techniques have not been entirely satisfactory, either because of performance or manufacturing efficiency. For example, many casting techniques require extensive finishing of the product before it is functionally or aesthetically acceptable, while many powder metallurgical processes do not result in a satisfactory density.

Particularly for heads that are made largely or entirely of metal, such as irons and putters, variations in materials and operating conditions have previously been suggested. For example, Shira, in U.S. Pat. No. 5,094,810, teaches using a ceramic mold for an initial compressing of metal powder, which is subsequently sintered. Sanford et al., in U.S. Pat. No. 5,665,014, suggest a two-piece golf club head formed by powder metal injection molding. However, a two-piece product requires extensive finishing.

Accordingly, a continuing need exists for a method of preparing metal molded articles for such applications as golf club heads and weights for golf club heads.

SUMMARY OF THE INVENTION

The present invention provides sintered molded articles having a density of about from 7.5 to 16.5 g/cm$^3$ and prepared from an admixture of metal particles comprising:

a. at least one stainless steel and b. about from 10% to 90%, by weight of the admixture, of at least one tungsten alloy comprising iron, nickel and copper.

The present invention further provides a process for preparing a molded article comprising a. admixing a feedstock comprising metal powder and binder;

b. molding the feedstock into an unsintered form;

c. removing the binder, and d. sintering the unsintered article for a time and at a temperature sufficient to densify the molded article to at least about 95% of the theoretical density of the metal.

The process and articles are useful in preparing products such as golf club heads.

DETAILED DESCRIPTION OF THE INVENTION

The sintered molded articles of the present invention are prepared from an admixture of metal particles comprising at least one stainless steel and at least one tungsten alloy. The desired weathering and other performance characteristics for a golf club head typically require a stainless steel. Stainless steels are alloys of iron and at least one other component to impart corrosion resistance. Alloying metals can typically include at least one of chromium, nickel, silicon, and molybdenum. Stainless steel alloys of iron and chromium have been found to be particularly satisfactory for golf club heads. Of these, "PH," or precipitation hardened, stainless steels are preferred, and 17–4 PH stainless steel is especially preferred. This stainless steel is an alloy of iron, 17% chromium, 4% nickel, 4% copper and 0.3% niobium plus tantalum, which has been treated by the known precipitation hardening process. These alloys can, however, optionally be used without the secondary heat treatment often used in precipitation hardening. In addition to excellent strength and corrosion resistance, parts prepared from this alloy exhibit unusually high resistance to permanent deformation. Martensitic and austenitic stainless steels can also be used in the present invention. Of the austenitic stainless steels, that designated as 316 is preferred, and the low-carbon grade identified as 316L has been found to be particularly satisfactory.

In accordance with the present invention, the stainless steel is used in combination with at least one tungsten alloy. Preferred alloying components include iron, nickel and copper. The tungsten alloy generally comprises about from 10% to 90% of the admixture of stainless steel and tungsten alloy. However, it is preferred that the ratio of stainless steel to tungsten alloy be about from 1:1 to 3:1. Specific tungsten alloys which can be used include those of Classifications 2 and 3 of SAE-AMS-T-21014.

In the preparation of molded articles in accordance with the present invention, the metal components, in powder form, are admixed with binder. For optimum performance in the injection molding process, the particle size of the metals is preferably about from 1 to 40 $\mu$m. The binder can be selected from a wide variety of known binder materials, including, for example, waxes, polyolefins such as polyethylenes and polyproplyenes, polystyrenes, polyvinyl chloride, polyethylene carbonate, polyethylene glycol and microcrystalline wax. The particular binder will be selected on the basis of compatibility with powder components, and ease of mixing, molding and debinding. Still other known factors in selecting a binder include toxicity, shelf life, strength, lubricity, biostability, and recyclability. The concentration of the binder is typically about from 25 to 50 volume %, based on the total composition. About from 30 to 40 volume % has been found to be particularly satisfactory.

Binders which can be used in the present invention include those water leachable binder systems described in U.S. Pat. No. 5,332,537. However, of the many binders which can be used in the present invention, those based on agar are preferred, such as those aqueous binders described in Fanelli et al., U.S. Pat. No. 4,734,237, Zedalis et al., U.S. Pat. No. 5,985,208 and Sekido et al., U.S. Pat. No. 5,258,155, each hereby incorporated by reference. In general, thermoplastic binders have been found to be particularly satisfactory, and are accordingly especially preferred.

The specific binder used will depend, in part, on the desired processing conditions. For example, binders that are extractable with water or mineral spirits can be used. Using aqueous agar binders, such as those described in the Fanelli et al. patent noted above, water serves the role of the fluid medium in the aqueous injection molding process, and agar provides the setting function in the molded part. The agar sets up a gel network with open channels in the part, allowing easy removal of the water by evaporation.

In general, the metal powder is first admixed with the organic binder using conventional blending techniques. The resulting mixture is formed into the desired shape using known metal injection molding (MIM) techniques, in a relatively cold mold. The binder can be removed by extraction with water or mineral spirits. The binder can also be removed by thermal treatment, typically carried out at temperatures of less than about 300° C. Thermal debinding temperatures of about from 200 to 250° C. are generally satisfactory.

The molded part is removed from the mold, debound, and then sintered. The specific sintering conditions will vary with the configuration of the desired shape and the metal and binder used. However, in general, the sintering is carried out at a temperature of about from 1260 to 1430° C. (2300 to 2600° F.) for a period of about from 45 minutes to 2 hours for the preferred metals and binders noted above. Particularly for the preferred stainless steel alloys, the sintering is carried out under conditions that minimize oxidation of the part. Such conditions include, for example, sintering in a partial vacuum or in a hydrogen atmosphere, or both. A hydrogen atmosphere is understood to comprise at least about 50% hydrogen, and preferably at least about 90% hydrogen. Preferably, any gas other than hydrogen is an inert gas such as argon or nitrogen The hydrogen has been found to promote densification of the part during sintering as well as reducing oxidation of the surface of the part, thereby minimizing the need for subsequent finishing. Still other environments for minimizing oxidation will be evident to those skilled in the art.

For the preferred materials used in the present invention, the final part is typically about 15% smaller than before sintering.

With tungsten and tungsten alloy, processing conditions are adjusted to minimize brittleness of the final product non-reactive binders are preferably used to minimize carbon residue which would otherwise form carbides, which, in turn, would result in brittleness.

While a variety of parts can be prepared according to the present invention, it is particularly advantageous in the preparation of golf club heads, putter heads and weights for insertion into clubs. If desired, weights of a metal heavier than the rest of the head can be incorporated into the mold. Such weights can be prepared, for example, from various alloys of tungsten and stainless steel.

After sintering, the unitary golf club head or other article is finished, typically by blasting with beads, such as silica, at high velocity.

The present invention is further illustrated by the following Examples, in which parts and percentages are by weight unless otherwise indicated.

EXAMPLE 1

17–4 PH stainless steel and tungsten alloy powders were blended with 6.3% by weight of thermoplastic polymeric binder. The stainless steel was a gas-atomized 18 $\mu$m SS powder. The tungsten alloy comprised tungsten and 2% each of iron, nickel and copper. The powders each had a particle size of 1–44 $\mu$m, and the theoretical density of the blend was 9.08 g/cm$^3$. The stainless steel and tungsten alloy were present in a ratio of 3:1. The blend was injected into a mold using injection molding techniques with 93.7% by weight of the metal. The blend was molded into the shape of a golf club heads. The heads were treated to remove the binder by immersion in mineral spirits to remove about 25% of the binder, and then further removing binder by heating in air up to a temperature of about 220° C. for 99 hours. Thereafter, the heads were sintered at a temperature of 1430° C. (2600° F.) for 1 hour, The sintered heads exhibited a density of 8.91 g/cm$^3$, or 98.1% of theoretical.

The resulting heads were finished by blasting with silica beads at high velocity. The finished heads were shafted, and found to provide excellent performance as irons.

EXAMPLE 2

The general procedure of Example 1 was repeated. 17–4 PH stainless steel and tungsten alloy powders were blended with 5.4% by weight of thermoplastic polymeric binder. The stainless steel was a gas-atomized 18 $\mu$m SS powder. The tungsten alloy comprised tungsten and 2% each of iron, nickel and copper. The powders each had a particle size of 1–44 $\mu$m, and the theoretical density of the blend was 10.76 g/cm$^3$. The stainless steel and tungsten alloys were present in a ratio of 1:1. The alloy blend was injected into a mold using injection molding techniques with 94.6% by weight of the metal. The blend was molded into the shape of sole weights for golf club heads. The weights were treated to remove the binder by heating in air up to a temperature of about 220° C. for 66 hours. Thereafter, the weights were sintered at a temperature of 1430° C. (2600° F.) for 1 hour. The sintered weights exhibited a density of 10.61 g/cm$^3$, or 98.6% of theoretical.

The resulting weights were finished by blasting with silica beads at high velocity. If the weights are installed on golf club heads, they will provide excellent performance characteristics.

We claim:

1. A sintered molded article having a density of about from 7.5 to 16.5 g/cm$^3$ and prepared from an admixture of metal particles comprising:

a. at least one stainless steel and b. about from 10% to 90% by weight of the admixture, of at least one tungsten alloy, wherein the tungsten alloy comprises iron, nickel and copper.

2. An article of claim 1 wherein the tungsten alloy comprises about 2% each of iron, nickel and copper.

3. An article of claim 1 wherein the ratio of stainless steel to tungsten alloy is about 3:1.

4. An article of claim 1 wherein the ratio of stainless steel to tungsten alloy is about 1:1.

5. An article of claim 1 in the configuration of a unitary golf club head.

6. An article of claim 5 wherein the golf club head comprises a hose.

* * * * *